US009008338B2

(12) United States Patent
Usami et al.

(10) Patent No.: US 9,008,338 B2
(45) Date of Patent: Apr. 14, 2015

(54) AUDIO REPRODUCTION APPARATUS AND AUDIO REPRODUCTION METHOD

(75) Inventors: Hikaru Usami, Osaka (JP); Naoya Tanaka, Osaka (JP); Toshihiko Date, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 367 days.

(21) Appl. No.: 13/504,095

(22) PCT Filed: Sep. 30, 2011

(86) PCT No.: PCT/JP2011/005546
§ 371 (c)(1),
(2), (4) Date: Apr. 25, 2012

(87) PCT Pub. No.: WO2012/042905
PCT Pub. Date: Apr. 5, 2012

(65) Prior Publication Data

US 2012/0213391 A1 Aug. 23, 2012

(30) Foreign Application Priority Data

Sep. 30, 2010 (JP) ..... 2010-222997

(51) Int. Cl.
*H04R 25/00* (2006.01)
*H04S 3/00* (2006.01)
*H04S 7/00* (2006.01)

(52) U.S. Cl.
CPC ..... *H04S 3/002* (2013.01); *H04S 7/302* (2013.01); *H04S 7/307* (2013.01); *H04R 2205/024* (2013.01)

(58) Field of Classification Search
USPC ..... 381/56, 303, 26, 1, 2, 310
See application file for complete search history.

(56) References Cited

U.S. PATENT DOCUMENTS 5,715,317 A * 2/1998 Nakazawa ..... 381/17
5,761,315 A * 6/1998 Iida et al. ..... 381/18

(Continued)

FOREIGN PATENT DOCUMENTS

JP 61-219300 9/1986
JP 2003-032782 1/2003

(Continued)

OTHER PUBLICATIONS

International Search Report issued in International Patent Application No. PCT/JP2011/005546, mailed Oct. 25, 2011.

*Primary Examiner* — Fan Tsang
*Assistant Examiner* — Angelica M McKinney
(74) *Attorney, Agent, or Firm* — McDermott Will & Emery LLP

(57) ABSTRACT

An audio reproduction apparatus is provided which is capable of maintaining the sense of dimensions in an acoustic space even when multi-channel input audio signals are reproduced using speakers having different frequency characteristics. The audio reproduction apparatus includes: a sound source position parameter calculating unit (3) that calculates a localization position of a sound image when reproduced by each of the first and second speaker groups; a reproduction signal generating unit (4) that generates a reproduction signal by separating, from audio signals corresponding to the second speaker group, audio signals representing a sound having a sound pressure level higher when reproduced by the first speaker group than the second speaker group; and a signal correction unit (8) that corrects reproduction signals such that the sound image localized according to the reproduction signals are localized at a substantially identical position to the calculated localization position; and a delay time adjusting unit (9).

8 Claims, 6 Drawing Sheets

(56) References Cited

U.S. PATENT DOCUMENTS

| | | | | |
|---|---|---|---|---|
| 6,285,766 | B1 * | 9/2001 | Kumamoto | 381/17 |
| 7,660,424 | B2 | 2/2010 | Davis | |
| 7,978,866 | B2 * | 7/2011 | Oteki | 381/310 |
| 8,050,434 | B1 * | 11/2011 | Kato et al. | 381/310 |
| 8,520,858 | B2 * | 8/2013 | Metcalf | 381/28 |
| 2003/0118192 | A1 * | 6/2003 | Sasaki | 381/17 |
| 2004/0062401 | A1 | 4/2004 | Davis | |
| 2005/0053249 | A1 * | 3/2005 | Wu et al. | 381/310 |
| 2005/0078833 | A1 * | 4/2005 | Hess et al. | 381/26 |
| 2005/0276420 | A1 | 12/2005 | Davis | |
| 2006/0062395 | A1 * | 3/2006 | Klayman et al. | 381/1 |
| 2006/0269068 | A1 * | 11/2006 | Yokota | 381/1 |
| 2007/0195964 | A1 | 8/2007 | Yokota | |
| 2008/0181416 | A1 * | 7/2008 | Jung | 381/2 |
| 2009/0097679 | A1 * | 4/2009 | Maeda | 381/302 |
| 2009/0208023 | A9 | 8/2009 | Davis | |
| 2012/0020481 | A1 | 1/2012 | Usami et al. | |

FOREIGN PATENT DOCUMENTS

| | | | |
|---|---|---|---|
| JP | 2007-195092 | | 8/2007 |
| JP | 2007-251832 | | 9/2007 |
| WO | WO 02/063925 | A2 | 8/2002 |
| WO | WO 2004/019656 | A2 | 3/2004 |
| WO | WO 2010/113434 | A1 | 10/2010 |

* cited by examiner

AUDIO REPRODUCTION APPARATUS AND AUDIO REPRODUCTION METHOD

RELATED APPLICATIONS

This application is the U.S. National Phase under 35 U.S.C. §371 of International Application No. PCT/JP2011/005546, filed on Sep. 30, 2011, which in turn claims the benefit of Japanese Application No. 2010-222997, filed on Sep. 30, 2010, the disclosures of which Applications are incorporated by reference herein.

TECHNICAL FIELD

The present invention relates to a technique of reproducing multi-channel audio signals using speakers having different frequency characteristics.

BACKGROUND ART

Multi-channel audio signals provided via digital versatile discs (DVD), Blu-ray discs (BD), digital television broadcasting, and so on are output from corresponding speakers each of which is placed at a predetermined position in an acoustic space, so as to implement audio reproduction with stereophonic perception. Such stereophonic perception can be obtained when the human auditory perception is made to perceive a sound source that actually does not exist as if it exists in an acoustic space. The sound source as in such a phenomenon is referred to as "sound image", and feeling as if the sound source exists is called "a sound image is localized".

Meanwhile, aside from the speaker systems that reproduce multi-channel audio signals, there is the case where plural speakers having different frequency characteristics are combined for use in a speaker system which includes plural speakers. This can be seen, for example, in the case where a speaker system including plural speakers is placed in a limited space such as a home.

In order to clear the limitation of placement space in a room such as that in a home, using a small speaker or a headphone instead of a large broadband speaker is effective. However, such a small speaker has frequency characteristics that a sound pressure level of a sound in a low-frequency range is lower than that of a large diameter speaker. In view of the above, a subwoofer speaker is provided, in order to compensate a bass sound pressure level, to the conventional speaker systems in which a small speaker is used.

SUMMARY OF INVENTION

Technical Problem

However, while it is certainly effective to use a subwoofer speaker for compensating the sound pressure level in the low-frequency range, the reproduction frequency range of the subwoofer speaker does not cover the entire frequency range of which the sound pressure level is insufficient when using the small speaker. In particular, the reproduction frequency characteristics of the subwoofer speaker is limited to the frequency range for a lower sound than a frequency range of mid bass sound that contributes to localization of sound images. With the frequency range of approximately 100 Hz or less as taken charge by the subwoofer, it is difficult to identify the direction of a sound source by a human auditory perception, and thus the sound image is difficult to be localized. Accordingly, the subwoofer is distinguished in use from other main speakers in the surround speaker system as well. Therefore, when compared with the case where multi-channel audio signals are reproduced in a speaker system including main speakers of a standard size, combining the small speaker and the subwoofer speaker still poses a problem that it is difficult to obtain stereophonic perception such as the sense of perspective or movement in an acoustic space and the sense of dimensions of a sound field stretching in the front-back directions.

In order to solve the above-stated problem, an object of the present invention is to provide an audio reproduction apparatus and an audio reproduction method which, even when some of the speakers are replaced with speakers having different frequency characteristics in a speaker system that includes plural speakers, allow obtaining stereophonic perception such as the sense of perspective or movement in an acoustic space and the sense of dimensions of a sound field stretching in the front-back directions, just as obtained prior to the replacement, by causing the sound image to be localized at a position substantially the same as the position before the replacement.

Solution to Problem

In order to solve the problem stated above, an audio reproduction apparatus according to an aspect of the present invention includes: a calculating unit configured to calculate a localization position of a sound image that is localized when it is assumed that audio signals corresponding to a first speaker group are reproduced by the first speaker group and audio signals corresponding to a second speaker group are reproduced by the second speaker group, the first speaker group including a plurality of speakers, and the second speaker group including a plurality of speakers having frequency characteristics different from frequency characteristics of the first speaker group; a generating unit configured to generate reproduction signals by (i) separating, from the audio signals corresponding to the second speaker group, audio signals each of which represents a sound that is included in a predetermined frequency range and has a sound pressure level that is higher when reproduced by the first speaker group than when reproduced by the second speaker group, among sounds represented by the audio signals corresponding to the second speaker group and (i) adding the separated audio signals to the audio signals corresponding to the first speaker group, each of the reproduction signals being for a corresponding one of the first speaker group and the second speaker group, and a correcting unit configured to correct the reproduction signals such that the sound image localized according to the reproduction signals is localized at a position substantially identical to the calculated localization position, each of the reproduction signals being generated for a corresponding one of the first speaker group and the second speaker group.

Advantageous Effects of Invention

According to the above-described configuration, in the audio reproduction apparatus according to an aspect of the present invention, the calculating unit calculates a localization position of a sound image that is localized when it is assumed that audio signals corresponding to a first speaker group are reproduced by the first speaker group and audio signals corresponding to a second speaker group are reproduced by the second speaker group. The first speaker group includes a plurality of speakers, and the second speaker group includes a plurality of speakers having frequency characteristics different from frequency characteristics of the first speaker group; The generating unit generates reproduction signals corresponding respectively to the first speaker group and the second speaker group, by separating, from the audio signals corresponding to the second speaker group, audio signals each of which indicates a sound, and adding the separated audio signal to the audio signals corresponding to the first speaker group, the sound being (i) indicated by the audio signals corresponding to the second speaker group, (ii) included in a predetermined frequency range, and (iii) having a sound pressure level that is higher when reproduced by the first speaker group than the sound pressure level when reproduced by the second speaker group. The correcting unit corrects the reproduction signals such that a sound image is localized at a position substantially identical to the calculated localization position, the sound image being localized according to the reproduction signals generated so as to correspond respectively to the first speaker group and the second speaker group.

Accordingly, it is possible to suppress the decrease in realistic sensation, which is attributed to that the sound pressure level of a sound included in the frequency range is lower when reproduced by the second speaker group including speakers positioned near ears of a viewer than a sound pressure level when reproduced by the first speaker group including speakers placed in front of the viewer, for example. It is to be noted that the first speaker group and the second speaker group are not limited to the above-described arrangement.

In addition, with the sound reproduction apparatus according to the present invention, it is possible to allocate energy to each of the channels of the first speaker group including speakers placed in front and the second speaker group positioned near the ears of a listener at the listening position, based on the position, in the acoustic space, of the sound source localization signal for localizing a sound image in the acoustic space, and also to allocate to the speakers placed in front by correcting the signal level and the delay time of a low-frequency sound of the sound source localization signal, even when the position of the sound source localization signal in the acoustic space is close to the listening position and allocated to the ear speaker.

According to the above-described configuration, even when a sound source localization signal is allocated to the ear speakers (i.e. the second speaker group) which have a high lower-limit reproduction frequency and with which the sound pressure level of a low-frequency sound is likely to decrease (in other words, the frequency characteristics are different from the frequency characteristics of the first speaker group), since the first speaker group can reproduce the low-frequency sound of the allocated sound source localization signals, it is possible to perform the reproduction without decreasing the sound pressure level even when the low-frequency sound is included in the allocated sound source localization signal, and thus it is possible to improve the sense of perspective or movement of the sound image that is localized in an acoustic space, thereby reproducing an effective stereophonic perception.

DESCRIPTION OF EMBODIMENTS

The following explains an embodiment of the present invention.

Embodiment 1

Figure 1:
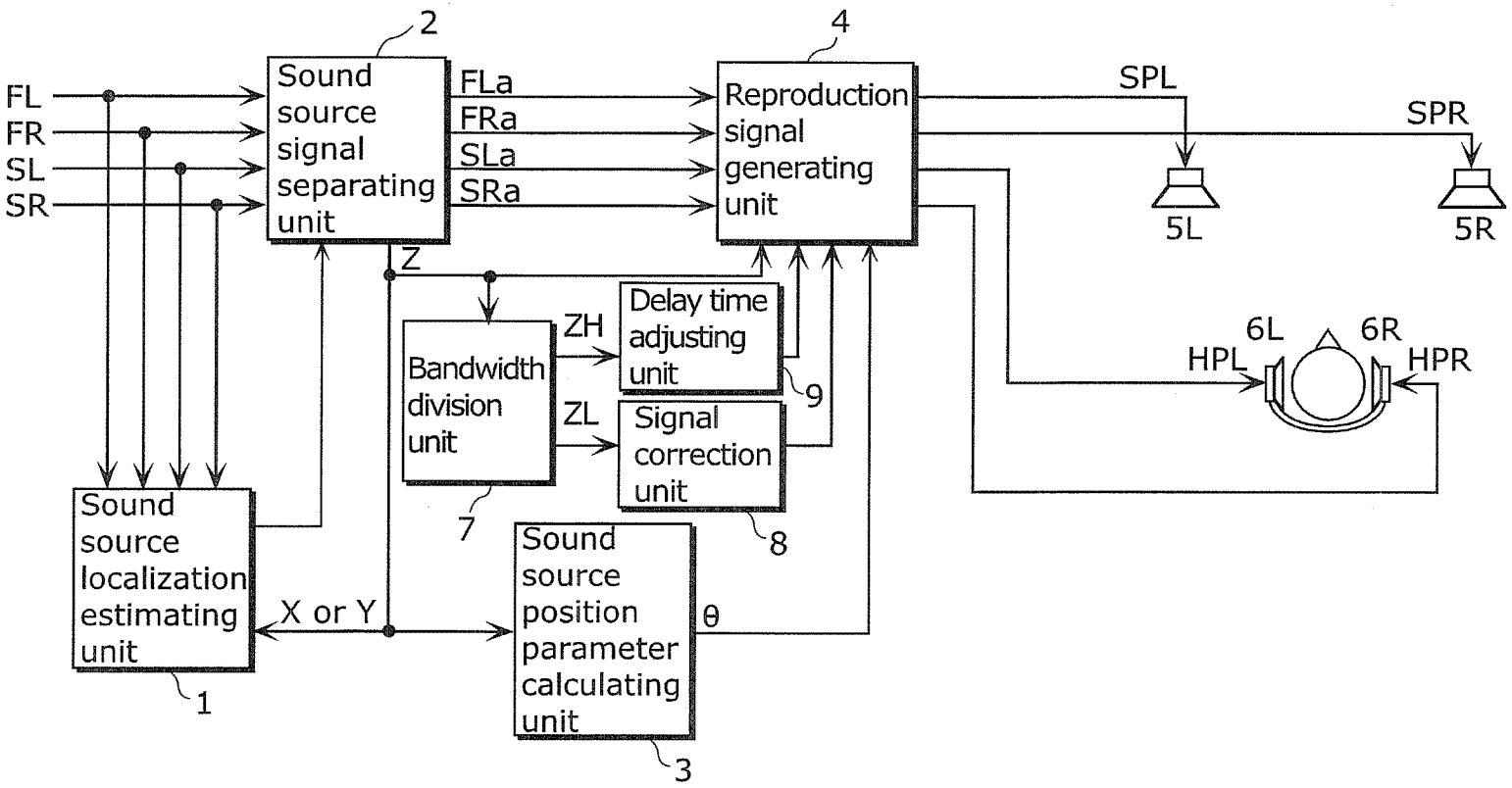
FIG. 1 is a diagram which shows a configuration of an audio reproduction apparatus according to an embodiment of the present invention.

FIG. 1 is a diagram illustrating a configuration of an audio reproduction apparatus according to an embodiment of the present invention.

FIG. 1 shows the audio reproduction apparatus including: a sound source localization estimating unit 1; a sound source signal separating unit 2; a sound source position parameter calculating unit 3; a reproduction signal generating unit 4; speakers 5L and 5R placed in front; ear speakers 6L and 6R; a bandwidth division unit 7; a signal correction unit 8; and a delay time adjusting unit 9. More specifically, the audio reproduction apparatus according to the present embodiment is an audio reproduction apparatus which generates a reproduction signal from an input audio signal, and outputs the reproduction signal to right and left front speakers and to right and left ear speakers each of which has frequency characteristics different from those of the right and left front speakers. The audio reproduction apparatus includes: a generating unit composed of the sound source localization estimating unit 1, the sound source signal separating unit 2, and the reproduction signal generating unit 4; a calculating unit composed of the sound source position parameter calculating unit 3; and a control unit composed of the bandwidth division unit 7, the signal correction unit 8, and the delay time adjusting unit 9. The generating unit generates a sound source localization signal that is a signal representing a sound image that is localized when an input audio signal is assumed to be reproduced using the right and left front speakers and the right and left ear speakers. The calculating unit calculates a parameter indicating a localization position of a sound image that is localized according to the sound source localization signal. The control unit (i) distributes, to the right and left front speakers, a sound which is included in a low-frequency range among sounds represented by the sound source localization signal and is to be reproduced by the right and left ear speakers, and of which a sound pressure is higher when reproduced by the right and left front speakers than reproduced by the right and left ear speakers, and (ii) generates the reproduction signal such that the sound image that is localized according to the sound source localization signal is localized at substantially the same position as in the case where the sound is distributed to the right and left ear speakers.

Figure 2:
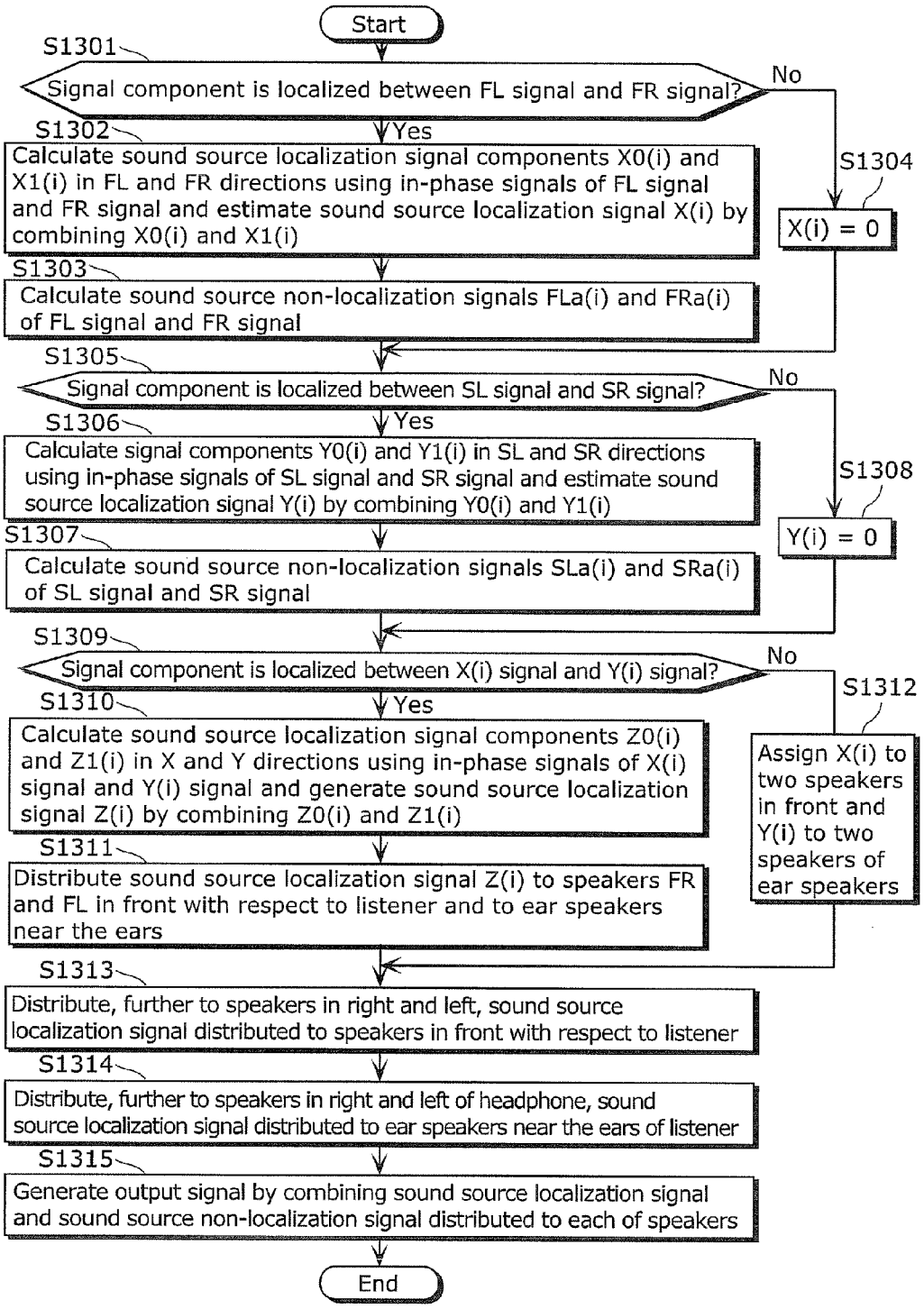
FIG. 2 is a flow chart which shows an operation of distributing sound source localization signals to each of the speakers based on a sound source position parameter, performed by the audio reproduction apparatus, according to the embodiment.

Detailed operations of the sound source localization estimating unit 1, the sound source signal separating unit 2, the sound source position parameter calculating unit 3, the reproduction signal generating unit 4, the speakers 5L and 5R placed in front, and the ear speakers 6L and 6R in the above-described audio reproduction apparatus have been described in Japanese Patent Application No. 2009-084551 proposed by the inventors of the present invention. Accordingly, a simple description is given, with reference to FIG. 2, in the following description. FIG. 2 is a flow chart which shows an operation of distributing sound source localization signals to each of the speakers based on a sound source position parameter, performed by the audio reproduction apparatus, according to the present embodiment. It is to be noted that, in FIG. 2, these processes might be seen as sequence processes; however, the case where processes are carried out in parallel is also included in practice.

Multi-channel input audio signals (an FL (front left) signal, an FR (front right) signal, an SL (surround left) signal, and SR (surround right) signal) are provided to the sound source localization estimating unit 1 and the sound source signal separating unit 2.

The sound source localization estimating unit 1 estimates, based on the input audio signals, whether or not a sound image is localized in an acoustic space. It is known that, when there is a signal having a high correlation between two channels of the audio signals, human auditory perception characteristics perceive a sound image that is localized according to the two audio signals in the acoustic space. The sound source localization estimating unit 1 estimates, based on the auditory perception characteristics, whether or not a sound image is localized, by checking the correlation between two input audio signals which make a pair among the multi-channel input audio signals (S1301). For example, a correlation coefficient of the multi-channel FL signal and FR signal is calculated, and it is estimated that a sound image is localized according to the FL signal and the FR signal when the calculated correlation coefficient exceeds a threshold. When the calculated correlation coefficient is equal to or smaller than the threshold, it is estimated that a sound image is not localized. The sound source localization estimating unit 1, in the same manner as above, estimates whether or not a sound image is localized according to the multi-channel SL signal and SR signal (S1305).

It is to be noted that each of the input audio signal and the reproduction audio signal is a time-series audio signal represented by digital data corresponding to a sample index i, and the process related to generation of the reproduction audio signal is carried out for each frame including consecutive N samples provided at a predetermined time interval.

In addition, the sound source localization estimating unit 1, when it is estimated that the sound source localization signal X(i) is localized according to the FL signal and the FR signal and the sound source localization signal Y(i) is localized according to the SL signal and the SR signal, estimates whether or not a sound source localization signal Z(i) is localized ultimately according to the sound source localization signal X(i) and the sound source localization signal Y(i) (S1309).

The result of estimation performed by the sound source localization estimating unit 1 is output to the sound source signal separating unit 2 and the sound source position parameter calculating unit 3.

The sound source signal separating unit 2 calculates a sound source localization signal from the input audio signals based on the result of estimating whether or not a sound source localization signal exists, and separates, from the input audio signals, a sound source non-localization signal which does not cause a sound image to be localized in the acoustic space. For example, when it is estimated that a sound image is localized according to the FL signal and the FR signal (Yes in S1301), the sound source signal separating unit 2 indicates the FL signal and the FR signal as vectors extending from a listener toward the respective speakers with the sound pressure level being the size of the vectors, and calculates the vector of the sound source localization signal synthesized from the two vectors. The sound source signal separating unit 2 calculates a vector X0 of the sound source localization signal included in the vector of the FL signal, using an in-phase signal of the FL signal and the FR signal, which is represented as a sum signal of the FL signal and the FR signal ((FL+FR)/2). The vector X0 is represented as a value resulting from multiplying the in-phase signal by a constant A, and the constant A is calculated such that the sum of residual errors between the FL signal and the in-phase signal is minimum. It is possible to separate the vector X0 of the sound source localization signal from the FL signal vector, using the constant A calculated as above. In the same manner as above, it is possible to separate the vector X1 of the sound source localization signal included in the FR signal (S1302). In addition, it is possible to separate the sound source non-localization signal FLa included in the FL signal from the FL signal and separate the sound source non-localization signal FRa included in the FR signal from the FR signal, using the energy conservation law (S1303). It is to be noted that when it is estimated that a sound image is not localized according to the FL signal and the FR signal (No in S1301), it is determined that sound source localization signal X(i)=0, and the process proceeds to the next step.

In the same manner as above, when it is estimated that a sound image is localized according to the SL signal and the SR signal (Yes in S1305), it is possible to separate, from the SL signal and the SR signal, the sound source localization signals Y0 and Y1 and the sound source non-localization signal SLa and SRa which are represented as the respective vectors (S1306, S1307). It is to be noted that when it is estimated that a sound image is not localized according to the SL signal and the SR signal (No in S1305), it is determined that sound source localization signal Y(i)=0, and the process proceeds to the next step.

In addition, the sound source signal separating unit 2 estimates whether or not the sound source localization signal Z(i) is localized, from the sound source localization signal X(i) and the sound source localization signal Y(i) (S1309), and when it is estimated to be localized, separates the vector Z0 of the sound source localization signal Z(i) in the direction of the sound source localization signal X(i) from the sound source localization signal X(i) and separates the vector Z1 of the sound source localization signal Z(i) in the direction of the sound source localization signal Y(i). In addition, the sound source signal separating unit 2 synthesizes Z0 and Z1 to generate Z(i) (S1310).

The sound source position parameter calculating unit 3 calculates, from the sound source localization signal separated by the sound source signal separating unit 2, a sound source position parameter that indicates a position of the sound source localization signal in the acoustic space. For example, the sound source position parameter calculating unit 3 calculates (i) an angle γ of a vector that indicates a direction of arrival of the sound source localization signal and (ii) energy for deriving a distance from the listening position to the sound source localization signal, as sound source position parameters which indicate the position of the sound source localization signal in the acoustic space. For example, by setting the energy L represented by the sum of the square of X0 and X1 of the sound source localization signal X(i) and the energy L0 (decibel) of the reference distance R0 (meter) from a point sound source, it is possible to calculate the distance R from the position of the sound source localization signal to the listening position when the sound source localization signal is regarded as the point sound source.

In the same manner as above, with respect to the sound source localization signal that is localized according to the SL signal and the SR signal, it is possible to calculate the angle that indicates the direction of arrival viewed from the listening position and the distance from the listening position to the sound source localization signal. In addition, with respect to the sound source localization signal Z(i) that is localized according to the sound source localization signal X(i) and the sound source localization signal Y(i), the angle that indicates the direction of arrival of the sound source localization signal Z viewed from the listening position and the distance from the listening position to the sound source localization signal Z(i) are calculated.

Figure 3:
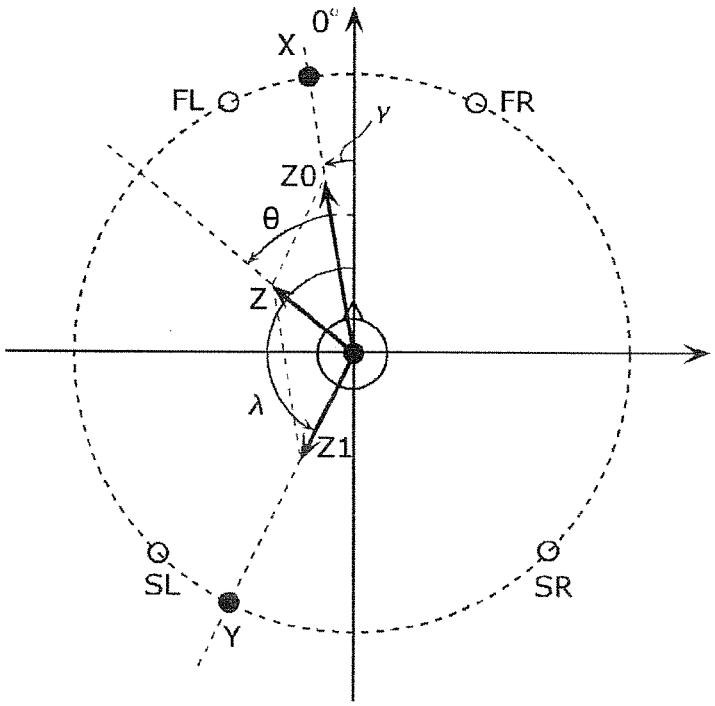
FIG. 3 is diagram which shows a relationship between a signal Z0(*i*) in the direction of a sound source localization signal X(i) and a signal Z1(*i*) in the direction of a sound source localization signal Y(i) which are included in a sound source localization signal Z(i) estimated from the sound source localization signals X(i) and Y(i).

FIG. 3 is a diagram which shows a sound source localization signal Z(i) estimated from the sound source localization signals X(i) and Y(i), and the relationship between the vector Z0(*i*) in the direction of the sound source localization signal X(i) and the vector Z1(*i*) in the direction of the sound source localization signal Y(i) in the acoustic space.

The sound source position parameter, which indicates the sound source localization signal Z(i) and is calculated by the sound source position parameter calculating unit 3, is output to the reproduction signal generating unit 4.

The reproduction signal generating unit 4 distributes, to each of the speakers 5L and 5R placed in front of the listening position and the ear speakers 6L and 6R placed near the listening position, the sound source localization signal Z(i) synthesized as shown in FIG. 3, based on the sound source position parameter indicating the sound source localization signal Z(i) (S1311).

For example, when the direction of arrival θ of the sound source localization signal Z(i) is $-n/2<\theta<n/2$ with the front direction of the listening position being the reference direction, the sound source localization signal Z(i) is distributed to the speakers 5L and 5R placed in front of the listening position at a rate of cos θ, and to the ear speakers 6L and 6R at a rate of (1.0−cos θ). Furthermore, when the direction of arrival of the sound source localization signal Z(i) is $\theta\leq-n/2$, $n/2\leq\theta$, the sound source localization signal Z(i) is distributed to the speakers 5L and 5R placed in front of the listening position at a rate of 0 time, and to the ear speakers 6L and 6R at a rate of 1.0 time. In addition, the larger the distance R from the localization position of the sound source localization signal Z(i) to the listening position is, the larger rate is distributed to the speakers 5L and 5R placed in front of the listening position. Likewise, the shorter the distance R is, the larger rate is distributed to the ear speakers 6L and 6R.

In addition, the reproduction signal generating unit 4, after distributing the sound source localization signal Z(i) to the two speakers in front and the two speakers in back, distributes the sound source localization signal Z(i) distributed to the speakers 5L and 5R in front, to right and left, for example, according to the direction of arrival θ of the sound source localization signal Z(i) (S1313). In addition, the reproduction signal generating unit 4 distributes the sound source localization signal Z(i) distributed to the ear speakers 6L and 6, to right and left, for example, according to the direction of arrival θ of the sound source localization signal Z(i) (S1314).

In addition, a reproduction audio signal is generated by synthesizing a sound source non-localization signal which is separated and corresponds to each of the channels, to the sound source localization signal distributed to each of the right and left speakers in front and back (S1315).

The reproduction signal generating unit 4 distributes the sound source localization signal Z(i) and the sound source non-localization signal corresponding to each of the channels to the speakers 5L and 5R placed in front of the listening position and to the ear speakers 6L and 6R, thereby making it possible to appreciate the reproduction of reproduction signals with realistic sensation same as the realistic sensation, such as the sense of perspective and the sense of movement at a sight where the sound is collected, even when a reproduction signal to be reproduced by the speakers corresponding to each of the channels is reproduced using a speaker placed at a different position.

It is to be noted that the speakers 5L and 5R placed in front are placed right and left in front with respect to the listening position, and are speakers having reproduction frequency characteristics with which audio can be reproduced at a high sound pressure level over a wide frequency range, for example.

In addition, when the ear speakers 6L and 6R are general headphones that are supported by a head or auricles, the ear speakers 6L and 6R are open-back headphones usable for listening to the reproduction audio signals output from the speakers 5L and 5R placed in front, concurrently with the reproduction audio signals output from the headphones. Alternatively, the ear speakers are not limited to headphones but may also be speakers or audio devices which output reproduction audio signals near the listening position.

The ear speakers 6L and 6R have a feature that the sound pressure level decreases when reproducing a sound in a low-frequency range. The sound in the low-frequency range is a sound having a frequency of approximately 100 to 200 Hz, for example, and a sound in a frequency range in which it is difficult to feel or recognize localization of a sound image by human auditory perception.

The bandwidth division unit 7 divides, into a low-frequency sound and a high-frequency sound, the sound source localization signal separated by the sound source signal separating unit 2. In the present embodiment, it is assumed that the bandwidth division unit 7 includes a low-pass filter and a high-pass filter which are set to arbitrary cutoff frequencies, for example. The bandwidth division unit 7 outputs, to the signal correction unit 8, a low-frequency sound ZL(i) of the sound source localization signal divided using the low-pass filter so as to be allocated to the speakers placed in front. The speakers 5L and 5R placed in front can reproduce the low-frequency sound without decreasing the sound pressure level. The low-frequency sound ZL(i) of the sound source localization signal is added, by the reproduction signal generating unit 4, to the sound source localization signal Zf(i) distributed to the speakers 5L and 5R placed in front, based on the sound source position parameter, after correction performed by the signal correction unit 8.

The signal correction unit 8 is a processing unit that corrects the audio characteristics of a low-frequency sound of the sound source localization signal. Here, the audio characteristics corrected by the signal correction unit 8 are, for example, the sound pressure level and/or the frequency characteristics.

The delay time adjusting unit 9 puts a delay of an arbitrary time on a high-frequency sound of the sound source localization signal which is reproduced by the ear speaker to which the distance from an ear is shorter, in order to adjust the timing of reproduction by separate speakers, such that a sound to be distributed to the ear speaker based on the sound source position parameter by the reproduction signal generating unit 4, which is distributed to the speaker placed in front due to having the low frequency, arrives at the ear at the same time as a sound having the high frequency which is distributed to the ear speaker based on the sound source position parameter due to not having the low frequency. The reason to do so is, when the ear speaker and the speaker placed in front concurrently reproduce sounds, since the sound reproduced by the speaker placed in front from which the distance to the ear is larger takes longer to arrive at the ear than the sound reproduced by the ear speaker, the sound having the low frequency is more likely to delay than the sound having the high frequency reproduced by the ear speaker. Accordingly, it is possible to cause the high-frequency sound and the low-frequency sound, which are distributed to the ear speakers based on the sound source position parameter, to arrive at the ears at the same time, by putting a delay on a sound that is reproduced by the ear speakers, thereby allowing more accurate reproduction of the sound source localization signal.

Furthermore, the following describes an example in which multi-channel input audio signals include four channels (FL signal, FR signal, SL signal, and SR signal) allocated to right and left in front (FL, FR) and right and left in back (SL, SR) with respect to the listening position.

It is to be noted that each of the input audio signal and the reproduction audio signal is a time-series audio signal represented by digital data corresponding to a sample index i, and the process related to generation of the reproduction audio signal is carried out for each frame including consecutive N samples provided at a predetermined time interval.

The following describes detailed operations of the audio reproduction apparatus according to an embodiment of the present invention.

The bandwidth division unit 7 performs bandwidth division on the sound source localization signal for localizing a sound image in an acoustic space, which is separated by the sound source signal separating unit 2, into a low-frequency sound and a high-frequency sound.

Here, when the ear speakers placed near the listening position are headphones that are supported by a head or auricles, the ear speakers are open-back headphones for concurrently listening to the audio signals output from the speakers placed in front. In general, with the open-back headphones, the sound pressure level decreases when reproducing a sound of a low-frequency range, and a lower limit reproduction frequency is higher than that of headphones which are not open-back. This is considered to be attributed to that, with the open-back headphones, a large diaphragm for converting an electric signal to a vibration of a sound wave is hard to use due to the restriction on the shape and the like, or particularly as to a sound having the low frequency, the vibration of a sound wave transmitted from the diaphragm is weakened by a vibration of a sound wave of an opposite phase which occurs in the back of the diaphragm.

Figure 4:
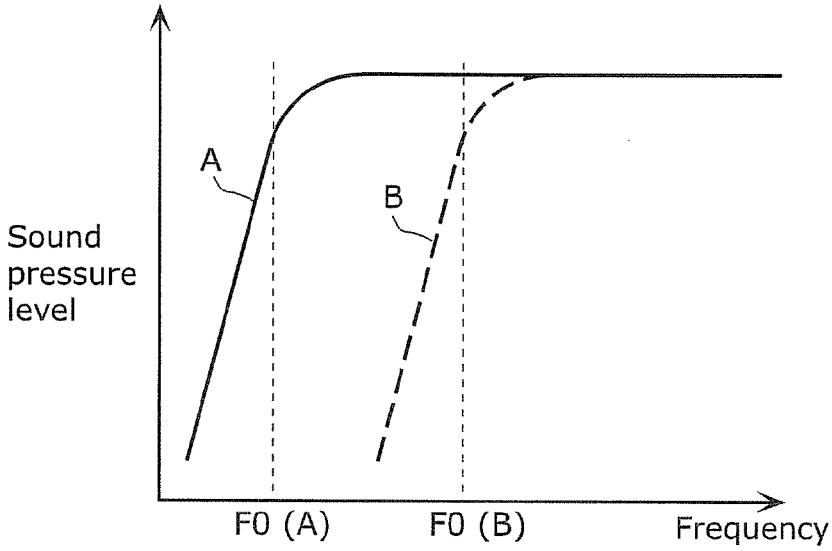
FIG. 4 is a diagram which shows reproduction frequency ranges of speakers placed in front of the listening position and ear speakers placed near the listening position.

FIG. 4 is a diagram which shows reproduction frequency ranges of the speakers placed in front of the listening position and the open-back headphones used as the ear speakers placed near the listening position.

Figure 5:
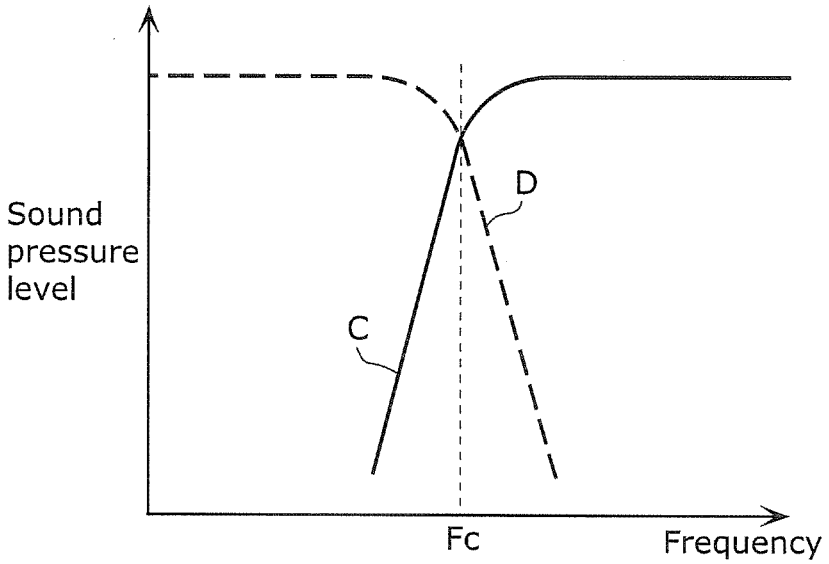
FIG. 5 is a diagram which shows frequency characteristics of a high-pass filter and a low-pass filter included in a bandwidth division unit.

In FIG. 4, the horizontal axis represents the frequency, and the vertical axis represents the sound pressure level. In addition, the solid line A indicates the reproduction frequency range of the speakers placed in front and the broken line B indicates the reproduction frequency range of the headphones used as the ears speakers. In addition, F0(A) indicates the lower-limit reproduction frequency of the speakers placed in front and the broken line B indicates the lower-limit reproduction frequency of the headphones used as the ears speakers FIG. 5 is a diagram which shows frequency characteristics of the bandwidth division unit that divides the sound source localization signal into a sound of high frequency and a sound of low frequency at a predetermined frequency as a boundary. In this diagram, two wave forms indicate the frequency characteristics of the high-pass filter and the low-pass filter, when the bandwidth division unit 7 includes the high-pass filter that divides the sound of the high frequency and the low-pass filter that divides the sound of the low frequency.

In FIG. 5, the horizontal axis represents the frequency, and the vertical axis represents the sound pressure level. In addition, the solid line C indicates the frequency characteristics of the high-pass filter (HPF), the broken line D indicates the frequency characteristics of the low-pass filter (LPF), and a cutoff frequency is set to Fc. The cutoff frequency Fc is set to an arbitrary frequency of (Fc≥F0(B)) with respect to the reproduction lower-limit reproduction frequency F0(B) of the headphone used as the ear speakers shown in FIG. 4.

The bandwidth division unit 7 described above divides, and output, the sound source localization signal Z(i) for localizing a sound image in the acoustic space, into a low-frequency sound ZL(i) and a high-frequency sound ZH(i).

It is to be noted that the lower-limit reproduction frequency F0(B) of the headphone used as the ear speakers shown in FIG. 4 depends on the speaker or the audio device used by the listener, and thus the frequency Fc at the boundary of the sound of the low-frequency and the sound of the high-frequency shown in FIG. 5 which are divided by the bandwidth division unit 7 may be adjustable in response to an instruction of the listener. This allows the listener to set the cutoff frequency Fc according to the frequency characteristics of the ear speakers at home.

The signal correction unit 8 corrects the sound pressure level and the frequency characteristics of the low-frequency sound ZL(i) divided by the bandwidth division unit 7. The correction of the sound pressure level performed by the signal correction unit 8 is set such that the difference is compensated between (i) an attenuation amount of the sound pressure level which attenuates before audio signals that are output from the speakers placed in front arrive at the ear of a listener and (ii) an attenuation amount of the sound pressure level which attenuates before audio signals that are output from the ear speakers placed near the listening position arrive at the ear of the listener. In addition, the correction of the frequency characteristics performed by the signal correction unit 8 is set such that the difference is compensated between (i) the frequency characteristics that change while transmitting through a path to the ear of the listener in the acoustic space when the audio signals are output from the speakers placed in front and (ii) the frequency characteristics that change while transmitting through a path to the ear of the listener in the acoustic space when the audio signals are output from the ear speakers.

Here, when a coefficient used in multiplying performed by the signal correction unit 8 for correcting the sound pressure level of the low-frequency sound ZL(i) is denoted as g, and a transfer function for correcting the frequency characteristics is denoted as T, a low-frequency sound ZL2(*i*) output from the signal correction unit 8 after the correcting is obtained by Expression 1.

[Math. 1]

$$ZL2(i)=g\times T\times ZL(i) \qquad \text{Expression 1}$$

The delay time adjusting unit 9 puts a delay by an arbitrary amount of time on the high-frequency sound ZH(i), which is divided by the bandwidth division unit 7. The delay time adjusted by the delay time adjusting unit 9 is set such that the difference is compensated between (i) an arrival time of the audio signal output from the speaker placed in front to the ear of the listener and (ii) an arrival time of the audio signal output from the ear speaker placed near the listening position to the ear of the listener, and that the audio signals that are output from the both speakers arrive at the ear at the same time. The delay time adjusting unit 9 outputs ZH2(*i*) resulting from the adjustment of the delay time performed on the high-frequency sound ZH(i), based on the delay time set as described above.

It is to be noted that, the signal correction unit 8 and the delay time adjusting unit 9 adjust (i) the sound pressure level and the frequency characteristics of a low-frequency sound and (ii) the delay time of a high-frequency sound, of the sound source localization signal, based on the position information of each of the speakers placed in front with respect to the listening position and the ear speakers placed near the listening position; however, the position information may be adjustable by an instruction of the listener. Alternatively, a sensor that automatically obtains the position information of each of the speakers may be used.

The reproduction signal generating unit 4 distributes the sound source localization signal Z(i) to each of the speakers placed in front of the listening position and the ear speakers placed near the ear of the listener such that energy is distributed based on the sound source position parameter of the sound source localization signal Z(i), and generates a reproduction signal by combining each of the sound source non-localization signals separated by the sound source signal separating unit 2 and the sound source localization signal Z(i).

As an example of this operation, the following describes the case where the sound source localization signal Z(i) is first distributed to the speakers placed in front of the listening position and the ear speakers placed near the ear of the listener, and then distributed to their respective right and left speakers.

First, for distributing the sound source localization signal to each of: the speakers placed in front of the listening position; and the ear speakers placed near the listening position, a function F(θ) for determining a distribution amount which is disclosed by Japanese Patent Application No. 2009-084551 is used. The sound source localization signal Zf(i) to be distributed to the speakers placed in front is calculated by multiplying the value of square root determined by the function F(θ), as the coefficient, by the sound source localization signal Z(i), as shown in Expression 2.

[Math. 2]

$$Z_f(i)=\sqrt{F(\theta)}\times Z(i) \qquad \text{Expression 2}$$

In addition, the low-frequency sound ZLh(i) of the sound source localization signal to be distributed to the ear speaker is calculated by multiplying the value of square root of (1.0−F(θ)) by the low-frequency sound ZL2(*i*) on which correction to the sound pressure level and the frequency characteristics are performed by the signal correction unit 8, instead of the sound source localization signal Z(i), as shown in Expression 3.

[Math. 3]

$$ZL_h(i)=\sqrt{1.0-F(\theta)}\times ZL2(i) \qquad \text{Expression 3}$$

In addition, the high-frequency sound ZHh(i) of the sound source localization signal to be distributed to the ear speakers is calculated by multiplying the value of square root of (1.0−F(θ)) by the high-frequency sound ZH2(*i*) on which adjustment of the delay time is performed by the delay time adjusting unit 9, instead of the sound source localization signal Z(i), as shown in Expression 4.

[Math. 4]

$$ZH_h(i)=\sqrt{1.0-F(\theta)}\times ZH2(i) \qquad \text{Expression 4}$$

Furthermore, in the same manner as in Japanese Patent Application No. 2009-084551, there is the case where a sound image that is localized is more clearly perceived by distributing the sound source localization signal to the ear speakers based on an energy of the sound source localization signal Z(i) than in the case where the sound source localization signal is distribute to the speakers placed in front. For example, the sound source localization signal is distributed using a function G(R) for determining the distribution amount disclosed by Japanese Patent Application No. 2009-084551, based on the distance R from the listening position to the sound source localization signal Z(i) among the sound source position parameters which indicate the position in the acoustic space.

In addition, for performing the distribution based on the distance R from the listening position, the sound source localization signal Zf(i) is calculated which is to be allocated to the speakers placed in front, by multiplying, by the sound source localization signal Z(i), the value of a square root resulting from multiplying the coefficient determined by the function G(R) based on the distance R from the listening position and the function F(θ) based on the angle θ indicating the direction of arrival, as shown in Expression 5.

[Math. 5]

$$Z_f(i)=\sqrt{G(R)\times F(\theta)}\times Z(i) \qquad \text{Expression 5}$$

In addition, the low-frequency sound ZLh(i) and the high-frequency sound ZHh(i) of the sound source localization signal to be distributed to the ear speakers are calculated by replacing the square root of (1.0−F(θ)) of Expression 3 and Expression 4 with a square root of (1.0−G(R)×F(θ)), as shown in Expression 6 and Expression 7.

[Math. 7]

$$ZL_h(i)=\sqrt{1.0-G(R)\times F(\theta)}\times ZL2(i) \qquad \text{Expression 6}$$

[Math. 7]

$$ZH_h(i)=\sqrt{1.0-G(R)\times F(\theta)}\times ZH2(i) \qquad \text{Expression 7}$$

Subsequent to the calculation of: the sound source localization signal Zf(i) to be distributed to the speakers placed in front; and the low-frequency sound ZLh(i) and the high-frequency sound ZHh(i) of the sound source localization signal to be distributed to the ear speakers placed near the listening position, as described above, the sound source localization signals are further distributed to their respective right and left channels.

Here, the process of distributing the sound source localization signal to each of the right and left channels of the speakers placed in front and the ear speakers placed near the listening position is performed in the same manner as the process disclosed by Japanese Patent Application No. 2009-084551, and thus the explanation for that will be omitted below. In addition, the sound source localization signals to be distributed to the speakers placed right and left in front are calculated as ZfL(i) and ZfR(i). In addition, ZLhL(i), ZLhR (i), ZHhL(i), and ZHhR(i) are calculated, where ZLhL(i) and ZLhR(i) are the low-frequency sounds and ZHhL(i) and ZHhR(i) are the high-frequency sounds of the sound source localization signals to be distributed to the ear speakers placed right and left near the listening position.

Finally, reproduction signals are generated by combining a sound source non-localization signal of each of the channels to a corresponding one of the sound source localization signals distributed to the respective speakers 5L and 5R placed in front and the ear speakers 6L and 6R placed near the listening position, as described above. In addition, in the same manner as in Japanese Patent Application No. 2009-084551, SLa(i) and SRa(i) are sound source non-localization signals included in the audio signals allocated to the right and left in back of the listening position, and thus a predetermined coefficient K is multiplied which is a coefficient for adjusting the energy level perceived by the listener.

In addition, as shown in Expression 8, the low-frequency sounds ZLhL(i) and ZLhR(i) of the sound source localization signals distributed to the ear speakers placed right and left near the listening position are added, to be synthesized, to the reproduction signal that is output to the speakers placed right and left in front.

[Math. 8]

$$\begin{cases} SPL(i) = Z_{fL}(i) + ZL_{hL}(i) + FL_a(i) \\ SPR(i) = Z_{fR}(i) + ZL_{hR}(i) + FR_a(i) \\ HPL(i) = ZH_{hL}(i) + K \times SL_a(i) \\ HPR(i) = ZH_{hR}(i) + K \times SR_a(i) \end{cases} \quad \text{Expression 8}$$

As described above, even when open-back headphones each having a high lower-limit reproduction frequency are used as ear speakers placed near the listening position, it is possible to reproduce the low-frequency sounds ZLhL(i) and ZLhR(i) of the sound source localization signals distributed to the ear speakers, without impairing the low-frequency sounds of the sound source localization signal that contributes to the localization of a sound image in the acoustic space, by correcting the sound pressure level and the frequency characteristics and outputting from the speakers placed in front which have a sufficiently low lower-limit reproduction frequency. In addition, it is possible to present distortion of a sound image that is localized in the acoustic space, by adjusting a delay time such that the high-frequency sound output from the ear speakers and the low-frequency sound output from the speakers placed in front as a result of re-distribution arrive at the ear of the listener at the same time.

Figure 6:
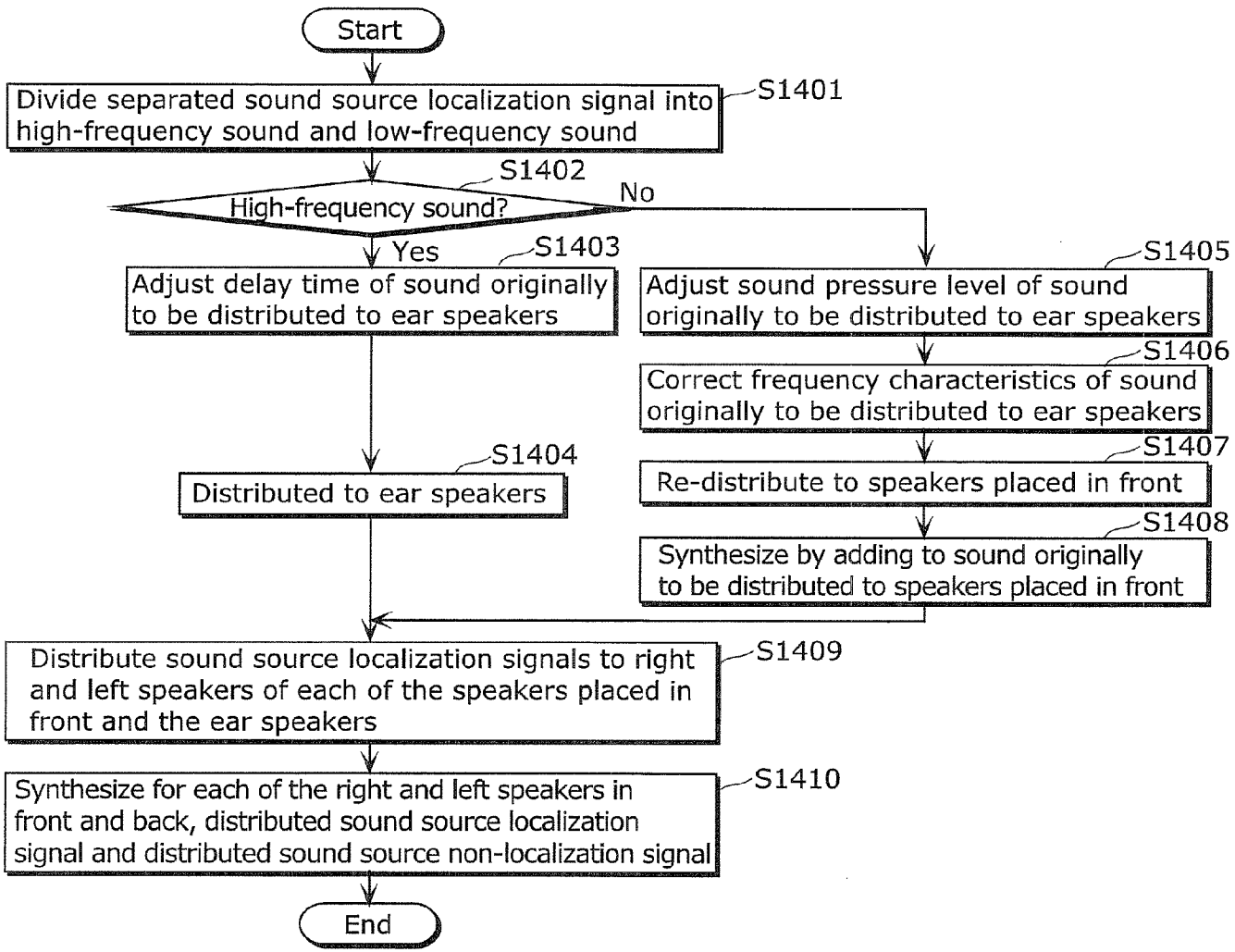
FIG. 6 is a flow chart which shows an operation of distributing sound source localization signals based on frequency characteristics of speaker groups, performed by the audio reproduction apparatus according to the embodiment.

The following describes, with reference to the flow chart, the flow of processes performed by the audio reproduction apparatus configured as described above. FIG. 6 is a flow chart which shows an operation of the audio reproduction apparatus according to the present embodiment. It is to be noted that the processing of each of the steps below is explained as a sequence processing in this diagram as well; however, the present invention is not limited to this, and the processing of each of the steps below may be performed in parallel or performed at once by function computing.

The bandwidth division unit 7 divides the sound source localization signal Z(i) separated by the sound source signal separating unit 2, into a high-frequency sound ZH(i) and a low-frequency sound ZL(i) (S1401), outputs the divided low-frequency sound ZL(i) to the signal correction unit 8 (NO in S1402), and outputs the divided high-frequency sound ZH(i) to the delay time adjusting unit 9 (Yes in S1402).

Next, the delay time adjusting unit 9 puts a delay on the input high-frequency sound ZH(i) (S1403) and outputs the delayed high-frequency sound ZH2(*i*) to the reproduction signal generating unit 4. The reproduction signal generating unit 4 distributes the delayed high-frequency sound ZH2(*i*) to the ear speakers (S1404). Meanwhile, the signal correction unit 8 corrects the sound pressure level of the input low-frequency sound ZL(i) using the coefficient g (S1405), corrects the frequency characteristics of the low-frequency sound using the transfer function T (S1406), and outputs the corrected low-frequency sound ZL2(*i*)=g×T×ZL(i), to the reproduction signal generating unit 7. The reproduction signal generating unit 4 performs calculation of a distribution function for re-distributing to the speakers placed in front, on the corrected low-frequency sound ZL2(*i*) (S1407), and perform synthesizing by adding the sound ZLh(i) to the sound Zf(i) ((Zf(i)+ZLh(i))) to be originally distributed to the speakers placed in front, based on the direction and distance of the sound source localization signal (S1408).

The reproduction signal generating unit 4 further distributes the sound Zf(i) of the sound source localization signal distributed to the speakers placed in front and the ear speakers, to the right and left speakers of each of the speakers placed in front and the ear speakers (S1409). In addition, for each of the right and left speakers in front and back, the sound of the sound source localization signal distributed to each of the speakers and the sound source non-localization signal are synthesized (S1410).

As described above, the audio reproduction apparatus according to an embodiment of the present invention estimates a sound source localization signal for localizing a sound image in an acoustic space in consideration of not only the horizontal direction in the acoustic space but also the back and forth directions, calculates a sound source position parameter that indicates the position of the sound source localization signal in the acoustic space, and distributes the sound source localization signal to distribute energy based on the sound source position parameter. Furthermore, even in the case where the open-back headphones having a high lower-limit reproduction frequency are used as the ear speakers, it is possible to prevent deterioration of reproduction of the sound image resulting from localization of the localization sound source in the acoustic space, and to reproduce a stereophonic audio with improved stereophonic perception such as spread of reproduction sound in front-back direction and movement of the sound image that localizes in the acoustic space, enabling obtaining more preferable realistic sensation.

In short, the audio reproduction apparatus according to an embodiment of the present invention is characterized by allocating, according to the reproduction characteristics of a speaker, a signal in the frequency range which is hard to be reproduced by the speaker, to a speaker that can easily reproduce the signal in the frequency range, and storing the localization of the original sound image.

In addition, a software program for implementing each of the processing steps of configuration blocks of the audio reproduction apparatus may be performed by a computer, a digital signal processor (DSP), and the like.

[Explanation of Terms]

The sound source signal separating unit 2 according to the embodiment described above corresponds to a generating unit that generates a sound source localization signal that is a signal indicating a sound image that localizes when it is assumed that the input audio signal is reproduced using the standard position speaker.

The sound source position parameter calculating unit 3 corresponds to a calculating unit that calculates a parameter that indicates a localization position of the sound image indicated by the sound source localization signal.

The bandwidth division unit 7 of the audio reproduction apparatus corresponds to a division unit that divides the sound source localization signal into a low-frequency sound and a high-frequency sound with the boundary being a frequency Fc, where Fc≥F0, with respect to the lower-limit frequency F0 in the reproducible frequency range of the ear speakers.

The signal correction unit 8 and the delay time adjusting unit 9 correspond to (i) a correcting unit that corrects a sound pressure level of a sound that is re-distributed among the sound source localization signals based on the position information of the standard position speakers placed in front of the listening position and the ear speakers, (ii) a correcting unit that corrects a frequency characteristics of the sound that is re-distributed among the sound source localization signals that are originally to be distributed to the ear speakers based on the position information of the standard position speakers placed in front of the listening position and the ear speakers, and (iii) a correcting unit that corrects a time when the sound that is re-distributed among the sound source localization signals that are originally to be distributed to the ear speakers based on the position information of the standard position speakers placed in front of the listening position and the ear speakers.

It is to be noted that, in the embodiment described above, the sound source localization signals are distributed to four speakers including the right and left speakers placed in front and the right and left ear speakers, and the low-frequency sound of which the sound pressure level decreases when reproduced by the ear speakers, out of the sound source localization signals distributed to the ear speakers, is re-distributed to the speakers placed in front. However, the present invention is not limited to this. The speakers to which a low-frequency sound of which the sound pressure level decreases at the ear speakers is re-distributed is not limited to the speakers placed in front, and may be a speaker placed not only in front but at any arbitrary position, as long as the speaker is capable of reproducing the low-frequency sound suppressing the decrease in the sound pressure level.

Figure 7:
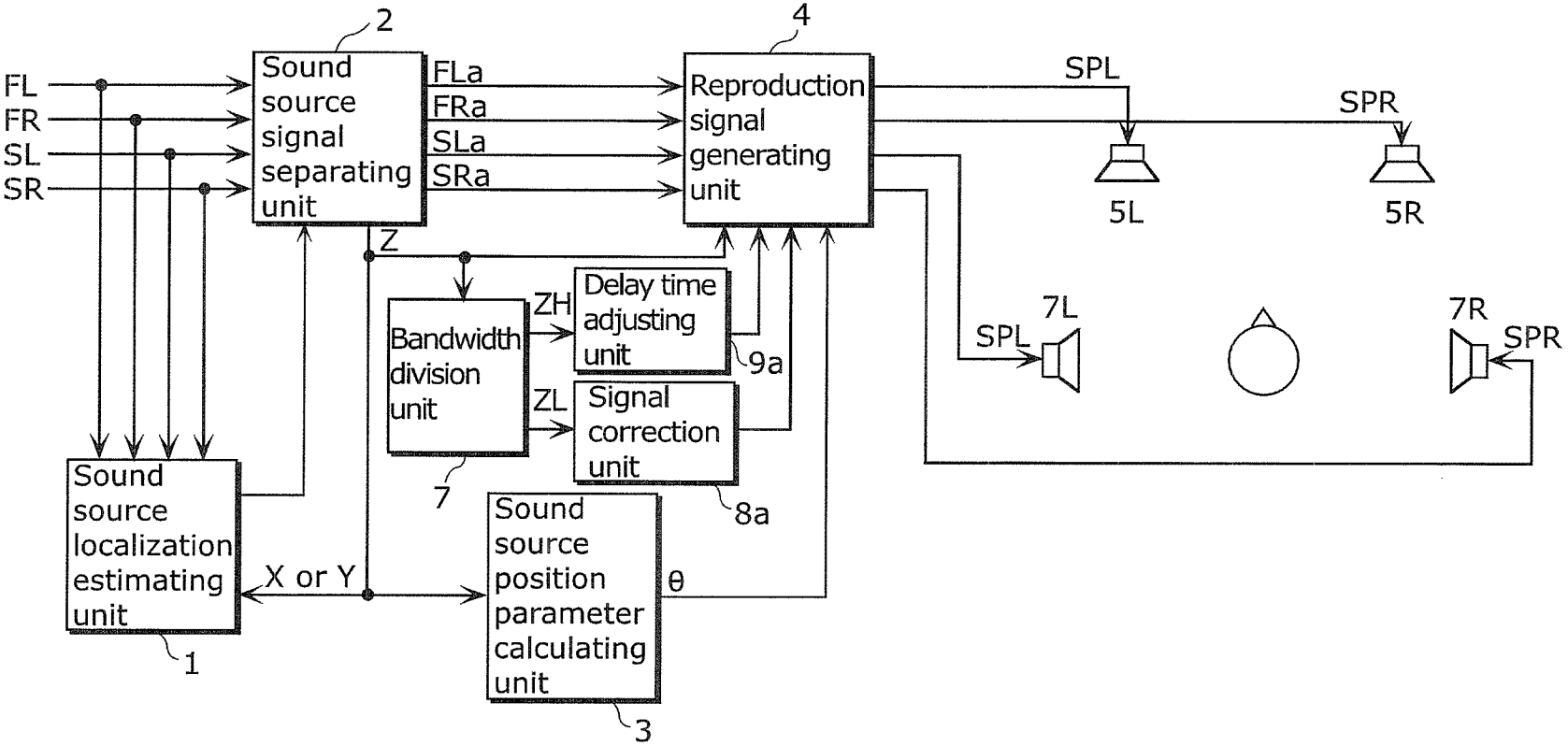
FIG. 7 is a diagram which shows another configuration example of the speaker system controlled by the audio reproduction apparatus according to the embodiment.

In addition, it is also unnecessary for the speakers corresponding to the ear speakers are placed near a listener. FIG. 7 is a diagram which shows another configuration example of the speaker system controlled by the audio reproduction apparatus according to the present embodiment. FIG. 7 shows an example in which small speakers 7L and 7R are placed slightly away from the ears, instead of placing at the positions of the ear speakers 6L and 6R according to the above-described embodiment. It is to be noted that, in this case, the ear speakers are changed from the open-back headphones to the small speakers; however, it is assumed that reproduction characteristics do not significantly differ between the headphone and the small speakers. The significant change shown by FIG. 7 is that the small speakers 7L and 7R corresponding to the ear speakers are placed in the same directions toward the ears and at positions slightly away from the ears. In such a case, it is possible to eliminate the need for adjustment of delay time performed by the delay time adjusting unit 9*a* when the distances from the small speakers 7L and 7R to their respective ears and the distances from the speakers 5L and 5R placed in front to their respective ears are the same. Conversely, when the distances from the small speakers 7L and 7R to their respective ears are larger than the distances from the speakers 5L and 5R placed in front to their respective ears, the delay time adjusting unit 9*a* performs adjustment such that the low-frequency sound re-distributed to the speakers 5L and 5R placed in front delay.

In addition, in the above-described embodiment, an example is presented in which the sound pressure level of a low-frequency sound included in a sound source localization signal allocated to the ear speakers decreases due to the use of the open-back headphones or the small speakers for the ear speakers. However, the present invention is not limited to this. For example, the frequency range of a sound of which the sound pressure level decreases when reproduced by the ear speakers according to the present embodiment is not limited to the low frequency but may be the high frequency or an intermediate frequency range. More specifically, the speakers which correspond to the ear speakers in this case are not necessarily open-back headphones, and may be speakers of which the sound pressure level of a sound in the high-frequency range is low, or may be other speakers of which the sound pressure level of a sound in a specific intermediate frequency range is low, for example. In the case where the sound pressure level of the sound in the high-frequency range decreases, for example, it is sufficient to re-distribute, based on the sound source position parameter, a high-frequency sound out of the sound source localization signals distributed to the speakers of which the sound pressure level of a sound in the high-frequency range is low, to other speakers capable of reproducing without a decrease in the sound pressure level, such as speakers placed in front. In this case as well, when there are speakers capable of reproducing a sound in the high-frequency without a decrease in the sound pressure level, other than the ear speaker of which the sound pressure level of a sound in the high-frequency range is low and the speakers placed in front, the sound in the high-frequency may be re-distributed to the speakers capable of reproducing a sound in the high-frequency without a decrease in the sound pressure level.

In addition, as the case where the sound pressure level of a sound in the intermediate frequency range decreases, it is considered that a combination of speakers does not succeed when configuring a broadband multi-way speaker by combining the speakers of different frequency ranges. In this case as well, when a sound is in a frequency range not suitable for reproduction, the sound is re-distributed to the other speaker, so that the sound in such a frequency range is reproduced without a decrease in the sound pressure level, and thereby making it possible to conserve localization of an original sound image.

In addition, according to an embodiment of the present invention, a range that completely corresponds to the frequency range in which the sound pressure level decreases when reproduced by the ear speaker is re-distributed to another speaker capable of reproducing a sound in the low-frequency without a decrease in the sound pressure level, such as the speaker placed in front. However, it is not necessary to re-distribute the range that completely corresponds to the range in which the sound pressure level decreases when reproduced by the ear speakers. A sound in a range including part of the frequency range in which the sound pressure level decreases when reproduced by the ear speakers, or a range wider than the entire frequency range in which the sound pressure level decreases when reproduced by the ear speakers, may be re-distributed to another speaker capable of reproducing a sound in the low-frequency without a decrease in the sound pressure level.

It should be noted that each of the function blocks (FIGS. 1 and 7, for example) is implemented into a large scale integration (LSI) which is typically an integrated circuit. The function blocks may be integrated into individual chips or some or all of them may be integrated into one chip.

For example, the function blocks except for the memory may be integrated into a single chip.

Although referred to as the LSI here, the integrated circuit may be referred to as an integrated circuit (IC), a system LSI, a super LSI, or an ultra LSI depending on the degree of integration.

A method for circuit integration is not limited to application of an LSI. It may be implemented as a dedicated circuit or a general-purpose processor. It is also possible to use a Field Programmable Gate Array (FPGA) that can be programmed after the LSI is manufactured, or a reconfigurable processor in which connection and setting of circuit cells inside the LSI can be reconfigured.

Moreover, when a circuit integration technology that replaces LSIs comes along owing to advances of the semiconductor technology or to a separate derivative technology, the function blocks should be understandably integrated using that technology. There can be a possibility of adaptation of biotechnology, for example.

Furthermore, of all the function blocks, only the unit storing data which is to be coded or decoded may not be integrated into the single chip and thus separately configured.

INDUSTRIAL APPLICABILITY

The present invention is applicable to a multi-channel surround speaker system and a control apparatus for the system, and in particular, to a home theater system, and so on.

The present invention is applicable to an audio reproduction apparatus which can solve the conventional technical problem, due to the combination of speakers having different frequency characteristics to configure a multi-channel speaker system, of impaired sense of perspective or sense of movement of a sound image that localizes in an acoustic space, compared with reproduction using a speaker system including speakers having the same frequency characteristics, and which can improves the stereophonic perception such as spread of reproduction sound in front-back direction, or the movement of the sound image that localizes in the acoustic space.

REFERENCE SIGNS LIST

1 sound source localization estimating unit
2 sound source signal separating unit
3 sound source position parameter calculating unit
4 reproduction signal generating unit
5L, 5R speakers placed right and left in front
6L, 6R speakers placed right and left near the listening position
7 bandwidth division unit
8, 8*a* signal correction unit
9, 9*a* delay time adjusting unit

The invention claimed is:

1. An audio reproduction apparatus comprising:

a calculating unit configured to calculate a localization position of a sound image that is localized, wherein audio signals corresponding to a first speaker group are reproduced by the first speaker group and audio signals corresponding to a second speaker group are reproduced by the second speaker group, the first speaker group including a plurality of speakers, and the second speaker group including a plurality of speakers having frequency characteristics different from frequency characteristics of the first speaker group;

a generating unit configured to generate reproduction signals by (i) separating, from the audio signals corresponding to the second speaker group, audio signals each of which represents a sound that is included in a predetermined frequency range and has a sound pressure level that is higher when reproduced by the first speaker group than when reproduced by the second speaker group, among sounds represented by the audio signals corresponding to the second speaker group and (i) adding the separated audio signals to the audio signals corresponding to the first speaker group, each of the reproduction signals being for a corresponding one of the first speaker group and the second speaker group; and a correcting unit configured to correct the reproduction signals such that the sound image localized according to the reproduction signals is localized at the calculated localization position, each of the reproduction signals being generated for a corresponding one of the first speaker group and the second speaker group.

2. The audio reproduction apparatus according to claim 1, wherein the speakers included in the first speaker group are a plurality of standard position speakers placed at predetermined standard positions, and the speakers included in the second speaker group are one or more near speakers each of which is placed at a position which is different from the standard positions and from which a distance to a listening position is shorter than a distance from each of the positions of the standard position speakers to the listening position.

3. The audio reproduction apparatus according to claim 2, wherein the near speakers are ear speakers placed near ears of a listener at the listening position, said audio reproduction apparatus further comprises a division unit configured to divide the audio signals corresponding to the second speaker group, into low-frequency sounds and high-frequency sounds, at a boundary of a frequency Fc that is equal to or larger than a lower-limit frequency F0 in a reproducible frequency range of the near speakers, and said generating unit is configured to generate the reproduction signals by re-distributing, to the standard position speakers, each of the low-frequency sound of the audio signals corresponding to the second speaker group that are originally to be distributed to the near speakers, the low-frequency sound resulting from the division performed by said division unit.

4. The audio reproduction apparatus according to claim 3, wherein said correcting unit is configured to correct, based on position information of each of the near speakers and each of the standard position speakers placed in front of the listening position, the sound pressure level of the sound that is re-distributed, such that the sound pressure level at the listening position when the sound that is re-distributed is reproduced by the standard position speakers becomes the sound pressure level at the listening position when the sound that is re-distributed is reproduced by the near speakers, and said generating unit is configured to generate the reproduction signals of the standard position speakers by combining the sound corrected by said correcting unit and the sound which is originally to be distributed to the standard position speakers.

5. The audio reproduction apparatus according to claim 3, wherein said correcting unit is configured to correct, based on position information of each of the near speakers and each of the standard position speakers placed in front of the listening position, the frequency characteristics of the sound that is re-distributed, such that the frequency characteristics at the listening position when the sound that is re-distributed is reproduced by the standard position speakers become the frequency characteristics at the listening position when the sound that is re-distributed is reproduced by the near speakers, and said generating unit is configured to generate the reproduction signals of the standard position speakers by combining the sound corrected by said correcting unit and the sound which is originally to be distributed to the standard position speakers.

6. The audio reproduction apparatus according to claim 3, wherein said correcting unit is configured to correct, based on position information of each of the near speakers and each of the standard position speakers placed in front of the listening position, an arrival time, at the listening position, of the sound that is re-distributed, to be an arrival time of a sound of the audio signals other than the sound that is re-distributed, by delaying the sound of the audio signals corresponding to the second speaker group other than the sound that is re-distributed, by an amount of time that the sound that is re-distributed delays in arriving at the listening position compared to the case where the sound is reproduced by the near speakers, and said generating unit is configured to generate the reproduction signal by combining the sound corrected by said correcting unit and the sound which is re-distributed.

7. The audio reproduction apparatus according to claim 3, further comprising a receiving unit configured to receive an input related to the frequency Fc for dividing the audio signals corresponding to the second speaker group into the low-frequency sounds and the high-frequency sounds, wherein said division unit is configured to adjust the frequency Fc according to an input from said receiving unit.

8. An audio reproduction method comprising:

calculating a localization position of a sound image that is localized, wherein audio signals corresponding to a first speaker group are reproduced by the first speaker group and audio signals corresponding to a second speaker group are reproduced by the second speaker group, the first speaker group including a plurality of speakers, and the second speaker group including a plurality of speakers having frequency characteristics different from frequency characteristics of the first speaker group;

generating reproduction signals by (i) separating, from the audio signals corresponding to the second speaker group, audio signals each of which represents a sound that is included in a predetermined frequency range and has a sound pressure level that is higher when reproduced by the first speaker group than when reproduced by the second speaker group, among sounds represented by the audio signals corresponding to the second speaker group and (i) adding the separated audio signals to the audio signals corresponding to the first speaker group, each of the reproduction signals being for a corresponding one of the first speaker group and the second speaker group, and correcting the reproduction signals such that the sound image localized according to the reproduction signals is localized at the calculated localization position, each of the reproduction signals being generated for a corresponding one of the first speaker group and the second speaker group.

* * * * *